US005548942A

United States Patent [19]

Zajec

[11] Patent Number: 5,548,942

[45] Date of Patent: Aug. 27, 1996

[54] METHOD AND APPARATUS FOR PACKAGING A ROLL OF MATERIAL

[75] Inventor: Jozef-Franc Zajec, Velden, Netherlands

[73] Assignee: Sulzer Papertec Krefeld GmbH, Krefeld, Germany

[21] Appl. No.: 340,120

[22] Filed: Nov. 15, 1994

[30] Foreign Application Priority Data

Nov. 29, 1993 [DE] Germany ..... 43 40 515.0

[51] Int. Cl.[6] ..... B65B 11/04; B65B 51/02; B65B 25/14

[52] U.S. Cl. ..... 53/465; 53/214

[58] Field of Search ..... 53/465, 461, 214, 53/211, 587

[56] References Cited

U.S. PATENT DOCUMENTS

| | | | |
|---|---|---|---|
| 1,351,809 | 9/1920 | Sutherland | 53/214 X |
| 1,989,183 | 1/1935 | Blake | 206/59 |
| 2,178,979 | 11/1939 | Von Hofe | 216/62 |
| 2,368,213 | 1/1945 | Gerlach | 53/465 X |
| 2,638,725 | 5/1953 | Hurter et al. | 53/214 X |
| 2,893,191 | 7/1959 | Lancaster | 53/389.3 X |
| 3,290,861 | 12/1966 | Prager | 53/214 |
| 3,494,095 | 2/1970 | Valvano | 53/465 |
| 4,608,807 | 9/1986 | Skripalle | 53/214 X |
| 4,716,709 | 1/1988 | Lamb, Sr. et al. | 53/399 |

FOREIGN PATENT DOCUMENTS

| | | |
|---|---|---|
| 0499954 | 8/1992 | European Pat. Off. . |
| 1947453 | 10/1966 | Germany . |
| 1275440 | 8/1968 | Germany . |
| 2631268 | 3/1977 | Germany . |
| 3435103 | 4/1986 | Germany . |
| 16008 | of 1915 | United Kingdom . |
| 761741 | 11/1954 | United Kingdom . |

*Primary Examiner*—James F. Coan
*Attorney, Agent, or Firm*—Darby & Darby, P.C.

[57] ABSTRACT

The packaging of a roll of material is achieved by coating at least one side of a packaging sheet with a water soluble adhesive. At least a portion of one side of the packaging sheet is wetted after the coating step and the packaging sheet is wound about the roll of material after the wetting step. The apparatus for packaging the roll of material includes an unwinding station, pulling equipment, a sheet severer, gluing equipment and a winding station. A packaging sheet is disposed in the unwinding station. The packaging sheet is coated on at least one surface with a water soluble adhesive. The pulling equipment has a device for pulling the packaging sheet from the unwinding station. The sheet severer has a device for severing the packaging sheet. The gluing equipment has a device for applying liquid to at least one surface of the packaging sheet. The winding station has a device for winding the packaging sheet about the roll of material.

18 Claims, 2 Drawing Sheets

1
2
3
4
5
6
7
8
9
10
11
12
13
14
15
16
17
18
19
20
21
22
23
24
25
26
27
28
29
30
31
32
33

METHOD AND APPARATUS FOR PACKAGING A ROLL OF MATERIAL

BACKGROUND OF THE INVENTION

1. Field of the Invention

The present invention relates to a method and apparatus for packaging a roll of material. More specifically, the present invention relates to a method and apparatus for packaging a roll which is enveloped by a packaging sheet, the surface of which, before it comes into contact with the roll of material is, at least sectionally, made adhesive. The apparatus includes an unwinding station, pulling equipment, a sheet severer, gluing equipment and a winding station. The packaging sheet travels from the unwinding station, through the various pieces of equipment to the winding station.

2. Description of the Related Art

Methods and apparatuses for packaging material rolls, such as paper rolls, have been known for many years. Conventionally, the pulling equipment pulls the packaging sheet from a supply roll in the unwinding station and advances the packaging sheet toward a gap, which is formed by the roll of material that is to be packaged and a supporting roller carrying this roll. Generally, several rolls of packaging sheets, each of different width, are kept in the unwinding station to permit the width of the packaging sheet to vary in accordance with the width of the material that is to be packaged. Before the beginning of the packaging sheet reaches the gap, the side of the packaging sheet, which faces the roll of material is made adhesive. This side of the packaging sheet is hereinafter referred to as the "upper side". The roll of material, which is to be packaged, then rotates with the help of a plurality of supporting rollers. When the packaging sheet reaches the gap between the roll and the supporting roller, it is glued there to the external periphery of the roll of material. The roll of material thereafter carries the packaging sheet. The packaging sheet is severed from its supply roll with the help of a severer after the packaging sheet has enveloped the roll of material adequately. The rotation of the roll of material continues until the severed end of the packaging sheet is wound about the roll. The end of the packaging sheet must also be made adhesive so that it adheres to the periphery of the roll. Therefore, glue must be applied at the beginning and at the end of the packaging sheet to ensure a durable envelopment of the roll of material. Alternatively, it is also known to apply adhesive to the whole surface of the packaging sheet so that the individual layers or windings of the packaging sheet around the roll of material adhere to one another.

Typically, a glue or adhesive is applied to the surface of the packaging sheet to make this surface adhesive. Glue nozzles or rollers have been used for this purpose. This type of gluing section is structurally relatively complex and is therefore correspondingly expensive. The conventional gluing section requires a high degree of supervision, because the glue can easily cure when the machine is stopped. Moreover, the gluing section constantly represents a potential source of contamination. If the glue application is not set with sufficient accuracy, it can lead to unsatisfactory packaging results. For example, insufficient glue may be applied or contamination of the roll of material may occur because too much glue has been applied causing the glue to pour out. Too much glue or adhesive can lead to contamination of the face of the roll of material, which in turn causes the individual layers of the roll of material to adhere to one another.

U.S. Pat. No. 4,716,709 and the European Patent No. 0 499 954 A1 disclose a different method for making the surface of the packaging sheet adhesive. Here a packaging sheet is coated with a hot-melt adhesive, such as polyethylene. The surface of the packaging sheet is heated before the packaging sheet enters a gap between the roll of material and the supporting roller. As a result, the layer melts and becomes adhesive, which leads to adherence of the packaging sheet to the roll. The use of a plastic-coated packaging sheet, however, has the serious disadvantage that its renewed use is decidedly difficult. The adhesive layer can be detached from the packaging sheet only with appreciable effort and leads to a waste product, which can be disposed of only with difficulty. Moreover, this type of gluing requires very careful monitoring of the packaging process so that, when the packaging sheet stops, there will be no overheating, which could lead to ignition of the adhesive layer and/or of the packaging sheet. Furthermore, heating the packaging sheet leads to a corresponding increase in temperature in the outer layers of the roll of material, which is to be packaged, with a corresponding shift in the temperature and the moisture of the atmosphere surrounding the outer layers.

SUMMARY OF THE INVENTION

It is an object of the present invention to provide packaging for a roll of material, which can be applied relatively safely, can be disposed of easily and requires only minimal supervision of the gluing equipment.

This objective is achieved by using a packaging sheet which is coated on at least one side with a water-soluble adhesive, and that adhesive is wetted before it comes into contact with the roll of material.

In order to make the sheet adhesive, it is only necessary to apply water and not glue. The "gluing section", that is, the glue-applying equipment can thus be constructed relatively simply. Additionally, as a rule, water does not lead to contamination or blockages. Therefore, the supervision and maintenance required is correspondingly low. The adhesive is made sticky by water, a phenomenon which is known, for example, from the backs of postage stamps. If too much water is applied inadvertently, the excess water can simply run off from the packaging sheet without leading to further contamination. Handling water as a wetting agent is relatively safe. Thus, during the use of the apparatus according to the present invention, there is neither the danger that an operator will injure him or herself on a hot part of the machine nor the danger of fire in the event of an interruption to the packaging process. If the packaging sheet is to be used again, the water-soluble adhesive can easily be washed out and thus separated from the packaging sheet, so that it is possible to reuse the material of the packaging sheet.

Preferably, a water-soluble, cold-setting glue is used as the adhesive. This cold-setting glue can be processed at ambient temperature. Thus, the temperature of the liquid that is used for the wetting does not have to be adjusted to achieve the necessary gluing. This further simplifies the implementation of the method of the present invention.

Preferably, the cold-setting glue is a product of animal origin, based on gelatin, or a product of vegetable origin, based on dextrin. If necessary, both types of cold setting glues can be disposed of biologically, that is, with the aid of microorganisms, so that the disposal of the packaging is further simplified.

Advantageously, according to the present invention, water is sprayed onto the adhesive to wet it. In paper plants, the spraying of a sheet of material is a familiar process because paper sheets are frequently provided with moisture in this manner in the production process to adjust their moisture profile to a particular value. The operators can thus refer to their experience gained in other productions areas and utilize this experience to control the wetting of the packaging sheet. The wetting can be controlled relatively well by spraying. Over all, it can be ensured that the amount of moisture reaching the packaging sheet is not greater than that reaching it when liquid glue is applied conventionally.

In a further preferred embodiment, alternate or additional provisions can be made so that the packaging sheet is passed through a roller application mechanism to achieve the wetting process. This is particularly advantageous for wetting the end of a packaging sheet, because the end can be wetted reliably without running the danger that the wetting liquid may be sprayed beyond the end of the packaging sheet. A two-dimensional wetting of the packaging sheet can be realized with the relatively simple structure of a roller application mechanism so that the whole of the surface of the packaging sheet is made adhesive. This leads to very stable packaging, in which the individual layers of the packaging sheet adhere to one another.

Preferably, the wetting in the longitudinal and/or the transverse direction of the packaging sheet is limited to specified areas. For example, the edges of the packaging sheet, which are later folded on the face, can be excluded from the wetting so that they are not made adhesive. These non-wetted areas optionally can also be limited to the first winding or the first few windings of the packaging sheet. In a different embodiment, gluing the beginning and the end of the packaging sheet can also be realized easily. For such a gluing, only the beginning of the packaging sheet is glued to the roll of material and the end of the packaging sheet is glued to the next lower-lying layer of the packaging sheet.

The object of the invention is accomplished with an apparatus that includes at least one packaging sheet that is coated with a water-soluble adhesive. The packaging sheet is housed in an unwinding station and gluing equipment is constructed as a liquid applicator.

As stated above, the production of an adhering surface is divided into two process steps. On the one hand, the packaging sheet is coated with a water-soluble or liquid-soluble adhesive. This adhesive does not adhere as long as it is dry. Only when this adhesive is wetted by a liquid does it and the upper side of the packaging sheet become adhesive. The packaging sheet can be coated elsewhere, for example, during the manufacture of the packaging sheet, so that contamination of the packaging equipment by adhesive is practically precluded. On the other hand, the application of a liquid can be realized without problems because a liquid applicator is, according to the present invention, a relatively simple structure and requires only minimal maintenance and supervision.

In a preferred embodiment, the gluing equipment includes a water sprayer which ejects water through one or several nozzles. The nozzles form a fog which deposits on the surface of the packaging sheet. Of course, it is also possible that larger droplets can be deposited directly on the surface of the packaging sheet and upon entering the gap the larger droplets are then distributed between the roller material and the supporting roller. The application of liquid can be controlled relatively accurately by the water sprayer.

The water sprayer produces a spraying jet, the width of which is adjustable. Thus, the amount of liquid applied can be varied according to the width of the packaging sheet, so that, when narrow packaging sheets are used for correspondingly narrow rolls of material, excessive amounts of liquid do not pass by the packaging sheet. Moreover, an adhesive pattern can be produced with such a water sprayer on the surface of the packaging sheet. Such a pattern, for example, can make only a central region at the beginning of the packaging sheet adhesive, leaving the edges untouched, in order to prevent gluing the face of the packaging sheet to the face of the roll of material that is to be packaged. On the other hand, subsequent windings of the packaging sheet can be made adhesive over the whole of their width, in order to bring about reliable adhesion of the packaging sheet to the lower-lying windings. To accomplish this, the water sprayer is preferably divided into several sections over the width of the packaging sheet and the supply of water to these sections can be separately controlled. Accordingly, the width of the distribution of the water distributed by the sprayer is controlled in steps. This step wise control is usually sufficient for producing the desired adhesiveness pattern on the upper side of the packaging sheet.

The gluing equipment can alternatively or additionally include a roller application mechanism. The roller mechanism uniformly transfers liquid to the upper side of the packaging sheet. The expenditure for construction and maintenance of the roller mechanism is as low as, if not lower than, that of the spray equipment. A roller application mechanism should especially be used when liquid is required to be applied inexpensively over a large surface. For example, in "end gluing", that is, for making the ends of the packaging sheet adhesive, a roller application mechanism is quite effective because it moistens the packaging sheet up to its end.

The roller application mechanism is preferably disposed, with respect to the direction of movement of the packaging sheet, after the water spraying equipment. The roller application mechanism includes a controlled contacting roller. The beginning of the packaging sheet is preferably moistened here by the water spraying equipment and is made adhesive, so that the beginning of the packaging sheet reliably adheres to the roll of material. Thereafter, the controlled contacting roller can move the tipper side of the packaging sheet into contact with the roller application mechanism to ensure the transfer of liquid to the upper side of tile packaging sheet. Subsequently, the water spraying equipment can be switched off, and the roller application mechanism can take over the process of moistening the tipper side of the packaging sheet.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENT INVENTION

Figures 1, 2:
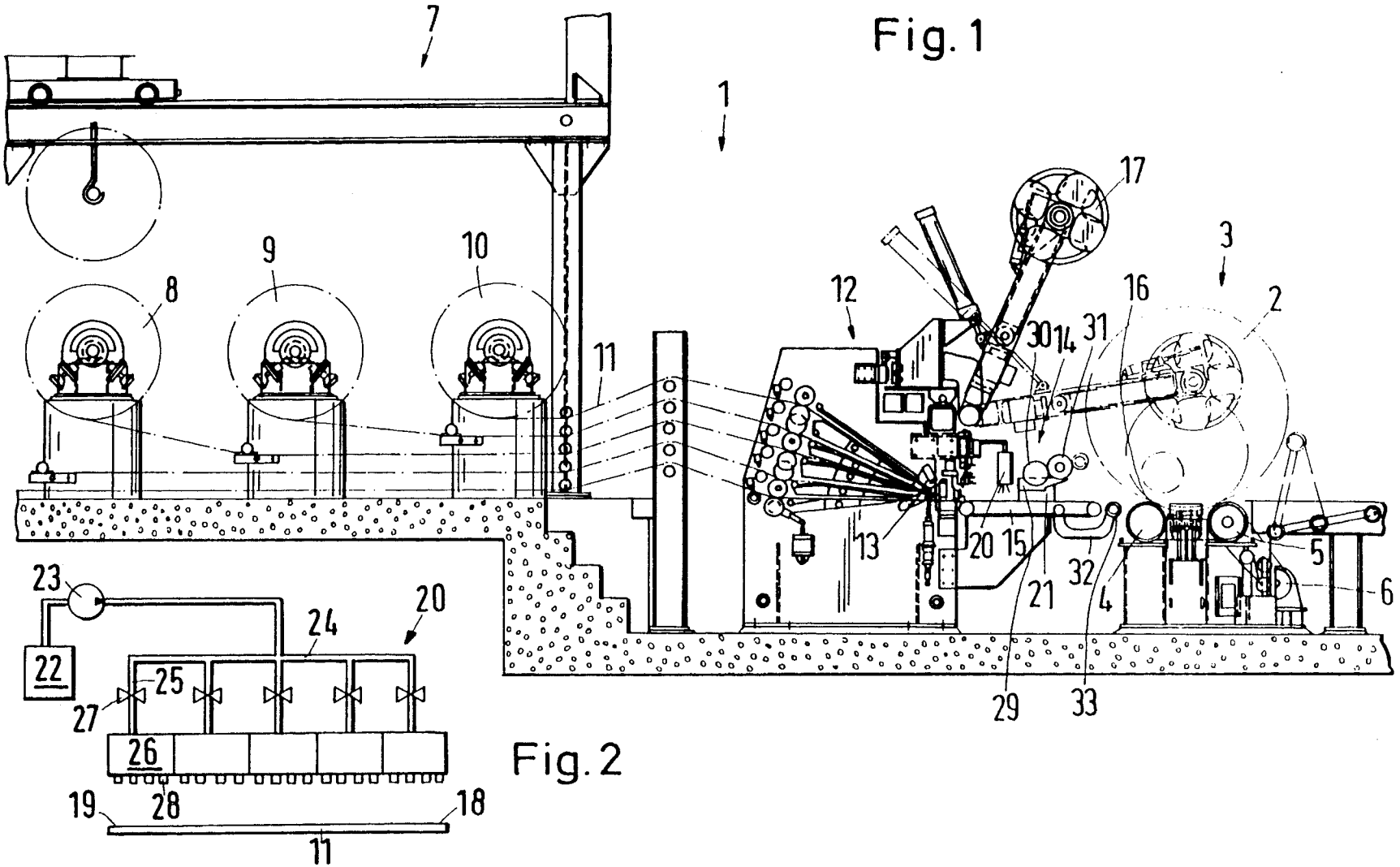
FIG. 1 is a side view of packaging equipment according to the present invention.
FIG. 2 is a representation of spraying equipment.

Referring to FIG. 1, an apparatus 1 for packaging a roll 2 of material is illustrated. The apparatus includes a winding station 3 and an unwinding station 7. Winding station 3 has two supporting rollers 4, 5, one of which is driven by a motor 6. Several supply rolls 8, 9, 10, of different width, for the packaging sheets 11, are disposed in the unwinding station 7. Of course, more than the three illustrated supply rolls can be used.

Pulling equipment 12, sheet severer 13 and gluing equipment 14 are disposed between the unwinding station 7 and the winding station 3. The packaging sheet 11 is unwound from one of the supply rolls 8, 9, 10, depending on the desired width, and sheet 11 is advanced over a transporting table 15 until it enters a gap 16 disposed between the roll 2 of material and the supporting roller 4. During the advance of the packaging sheet 11 over the transporting table 15, the gluing equipment 14 is activated and causes the upper side 18 of the packaging sheet 11, that is, the side of sheet 11 facing the roll 2, to become adhesive. During the advance of the packaging sheet 11, the roll 2 of material is set in rotation by the motor-driven supporting roller 5. As soon as the packaging sheet 11 enters the gap 16, it adheres to the roll 2 of material and is thereafter carried along by roll 2. As soon as the necessary number of layers of the packaging sheet 11 are wound onto the roll 2 of material, the sheet severer 13 severs the packaging street 11 from the supply roll 8, 9 or 10. The roll 2 of material is rotated further and the severed end of the sheet of material 11 is wound completely onto itself. While the roll 2 of material is being wound with the packaging sheet 11, an overhang of the packaging sheet 11 is folded in, onto the face of the roll 2 of material in a conventional manner, with aid of a star wheel 17.

On its upper side, packaging sheet 11 is preferably coated with a water-soluble cold-setting glue. This cold-setting glue can, for example, be an animal product, based on gelatin, or a vegetable product, based on dextrin. The coating 19 does not become adhesive as long as it is dry. Only when moisture, such as water, is supplied does coating 19 become adhesive. This effect is known, for example, from the backs of conventional postage stamps.

To supply moisture to the upper side of packaging sheet 11, the gluing equipment includes a water-spraying device 20 and a roller application mechanism 21. Mechanism 21 is disposed, with respect to the direction of motion of the packaging sheet 11, after or downstream from the water-spraying equipment 20. In other words, the roller application mechanism 21 is disposed between the water-spraying equipment 20 and the winding station 3.

As shown in FIG. 2, the water-spraying equipment 20 receives water from a reservoir 22 by means of a pump 23. The pump supplies a distributing main 24, from which branch pipelines 25 lead to individual sections 26, into which the water-spraying equipment is subdivided in the transverse direction. Each branch pipeline is provided with its own valve 27, each of which can be controlled individually. A predetermined number of spraying nozzles 28, which atomize the emerging water and cause the water to be deposited on the coating 19, are disposed in each section 26. Wherever the water strikes the upper side 18 of the packaging sheet 11, that portion of the upper side becomes adhesive. By selectively controlling individual sections 26, the application of moisture on the packaging sheet 11 can be controlled. For example, the width of the spray can be controlled to adapt the application of moisture to the width of the particular packaging sheet 11. Additionally, sections 26 can be selectively controlled to permit only a part of the width of the packaging sheet 11 to become adhesive. This is especially desirable for the first winding of the packaging sheet 11 around the roll 2 to prevent regions of the packaging sheet 11, which have been made adhesive, from being folded onto the axial face of the roll 2 of material.

Figure 3:
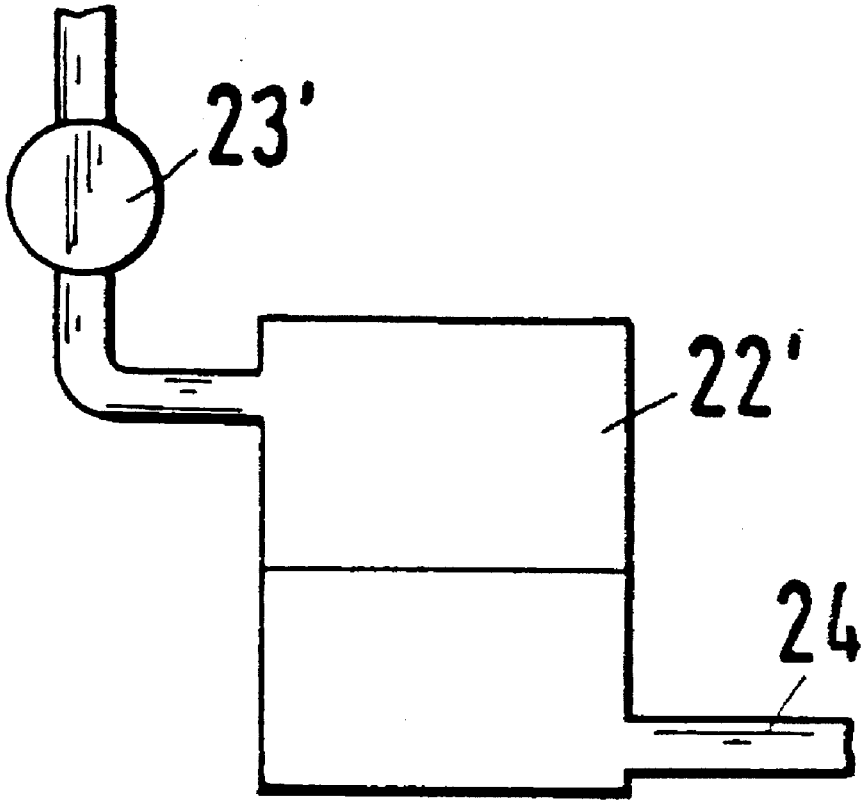
FIG. 3 is an alternative design of a water supply according to the present invention.

An alternate embodiment of the reservoir-pump arrangement is shown in FIG. 3. Pressure from pump 23' acts directly upon reservoir 22'. Pump 23' can apply either water or compressed air pressure to reservoir 22'. Reservoir 22' is connected directly to pipeline 24.

The roller application mechanism 21 has a reservoir 29, into which the transfer roll 30 dips. The transfer roll, in turn, is in contact with a driven application roller 31 and supplies this application roller 31 with moisture from the reservoir 29. Furthermore, a contacting roller 33 is pivotally fastened to a swivel arm 32 and can be pivoted out of a rest position, which is shown with solid lines, into a position, which is shown in phantom, where roller 33 causes the upper side 18 of the packaging sheet to be pressed against the application roller 31. In this position, the application roller 31 transfers moisture to the upper side 18 of the sheet of material 11, thus making the coating 19 adhesive.

The operation of the gluing equipment 14 will now be described below. As soon as the packaging sheet is advanced on the transporting table 15, the water-spraying equipment 20 is set into action. Water-spraying equipment 20 is disposed above the transporting table 15 and sprays water onto the upper side 18 of the packaging sheet 11. The spraying equipment 20 can also have a lesser width here than the packaging sheet 11. Basically, it is only necessary that an adhesive region be produced such that the packaging sheet 11 adheres to the roll 2 of material. As soon as a connection is produced between the roll 2 and the packaging sheet 11 and, optionally, a desired number of windings have been wound onto the roll 2 of material, the swivel arm 32 pivots upward and causes contacting roll 33 to press the packaging sheet 11 against the application roller 31. As a result, packaging sheet 11 is wetted over the whole width of its upper side 18. The water-spraying equipment 20 can now be switched off, because the complete moisture application is now applied by the roller application mechanism 21. Thus, upper side 18 of the packaging sheet 11 is wetted completely without any moisture being sprayed past sheet 11 and reaching the transporting table 15. This is especially true after the end of the packaging sheet 11 is severed by the sheet severer 13.

Having described the presently preferred exemplary embodiment of a new and improved method and apparatus for packaging a roll of material, in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

I claim:

1. A method of packaging a roll of material, said roll of material having a predetermined width, said method comprising the steps of:

coating at least one side of a packaging sheet with a water soluble adhesive, said packaging sheet having a predetermined width that is matched to the width of said roll of material;

wetting at least a portion of at least one side of the packaging sheet after the coating step; and winding the packaging sheet about the roll of material after the wetting step.

2. The method according to claim 1, wherein the water-soluble adhesive is a cold-setting glue.

3. The method according to claim 2, wherein the cold-setting glue is a product of animal origin.

4. The method according to claim 2, wherein the cold-setting glue is a product of vegetable origin.

5. The method according to claim 1, wherein the wetting step includes spraying water onto the adhesive.

6. The method according to claim 1, wherein the wetting step includes passing the packaging sheet through a roller application mechanism.

7. The method according to claim 1, wherein the wetting step is limited in a longitudinal and a transverse direction of the packaging sheet to predetermined areas.

8. The method according to claim 1, wherein said width of said packaging sheet is greater than said width of said roll of material so that said packaging sheet protrudes beyond an axial end of said roll of material and can be folded in onto an axial face of said roll of material.

9. The method according to claim 1, wherein the width of the packaging sheet is approximately equal to or greater than the width of the roll of material.

10. An apparatus for packaging a roll of material, said roll of material having a predetermined width, said apparatus comprising:

an unwinding station, a packaging sheet being disposed in said unwinding station, said packaging sheet being coated on at least one surface with a water soluble adhesive, said packaging sheet having a predetermined width that is matched to the width of said roll of material;

pulling equipment having means for pulling said packaging sheet from said unwinding station;

a sheet severer having means for severing said packaging sheet;

gluing equipment having means for applying water to said at least one surface of said packaging sheet; and a winding station having means for winding said packaging sheet about said roll of material.

11. The apparatus according to claim 10 wherein said gluing equipment includes a water sprayer.

12. The apparatus according to claim 8, wherein said gluing equipment includes a roller application mechanism.

13. The apparatus according to claim 9, wherein said gluing equipment includes a roller application mechanism.

14. The apparatus according to claim 13, wherein said roller application mechanism is disposed, with respect to a direction of the pulling of the packaging sheet, after said water sprayer, said roller application mechanism includes a roller which is selectively controlled to contact said packaging sheet.

15. The apparatus according to claim 11 wherein said water sprayer includes a means for producing a spray jet such that the width of said spray jet is adjustable.

16. The apparatus according to claim 11, wherein said water sprayer is subdivided into a plurality of sections such that a supply of water to each of said plurality of sections can be individually controlled.

17. The apparatus according to claim 8, wherein said width of said packaging sheet is greater than said width of said roll of material so that said packaging sheet protrudes beyond an axial end of said roll of material and can be folded in onto an axial face of said roll of material.

18. The apparatus according to claim 8, wherein the width of the packaging sheet is approximately equal to or greater than the width of the roll of material.

* * * * *

UNITED STATES PATENT AND TRADEMARK OFFICE

CERTIFICATE OF CORRECTION

PATENT NO. : 5,548,942
DATED : August 27, 1996
INVENTOR(S) : Jozef-Franc Zajec

It is certified that error appears in the above-indentified patent and that said Letters Patent is hereby corrected as shown below:

Title page, [30], Foreign Application Priority Data, Change "43 40 515.0" to --P 43 40 515.0--.

Signed and Sealed this

Eighth Day of April, 1997

Bruce Lehman

*Attest:*

BRUCE LEHMAN

*Attesting Officer*

*Commissioner of Patents and Trademarks*